US006208079B1

(12) United States Patent
Brown, II

(10) Patent No.: US 6,208,079 B1
(45) Date of Patent: Mar. 27, 2001

(54) CIRCUMFERENTIALLY-SEGMENTED COLLECTOR USABLE WITH A TWT

(75) Inventor: Richard A. Brown, II, Long Beach, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/352,587

(22) Filed: Jul. 13, 1999

Related U.S. Application Data

(63) Continuation of application No. 08/944,652, filed on Oct. 6, 1997, now abandoned.

(51) Int. Cl.[7] ..... H01J 23/027; H01J 25/36
(52) U.S. Cl. ..... 315/3.5; 315/5.38; 445/35
(58) Field of Search ..... 315/5.38, 3.5; 445/23, 35

(56) References Cited

U.S. PATENT DOCUMENTS

| | | | | |
|---|---|---|---|---|
| 2,325,865 | | 8/1943 | Litton | 315/5.38 |
| 3,188,515 | | 6/1965 | Kompfner | 315/5.38 X |
| 3,202,863 | * | 8/1965 | Dunn et al. | 315/5.38 |
| 4,527,092 | | 7/1985 | Ebihara | 315/5.38 |
| 5,952,785 | * | 9/1999 | Komm et al. | 315/5.38 X |

FOREIGN PATENT DOCUMENTS

| | | | | |
|---|---|---|---|---|
| 2633326 | * | 1/1978 | (DE) | 315/5.38 |

* cited by examiner

*Primary Examiner*—Benny T. Lee
(74) *Attorney, Agent, or Firm*—T. Gudmestad

(57) ABSTRACT

A TWT collector has axially-positioned collector stages in which at least one of the stages includes a plurality of annularly-arranged stage segments. The collector enhances electron beam velocity sorting by facilitating a combination of (a) selecting axial electric field distributions with application of selected voltages to the axially-positioned collector stages and (b) selecting radial electric field distributions with application of selected voltages to the annularly-arranged stage segments.

4 Claims, 4 Drawing Sheets

CIRCUMFERENTIALLY-SEGMENTED COLLECTOR USABLE WITH A TWT

This is a continuation of application Ser. No. 08/944,652 filed Oct. 6, 1997, now abandoned.

This invention described herein was made in the performance of work under NASA contract No. NAS3-27363 and is subject to the provisions of Section 305 of the National Aeronautics and Space Act of 1958 (72 Stat.435;42U.S.C.2457)

BACKGROUND OF THE INVENTION

1. Description of the Related Art

The present invention relates generally to travelling-wave tubes and more particularly to travelling-wave tube collectors.

2. Description of the Related Art

An exemplary traveling-wave tube (TWT) 20 is illustrated in FIG. 1. The elements of the TWT 20 are generally coaxially-arranged along a TVVT axis 21. They include an electron gun 22, a slow-wave structure 24 (embodiments of which are shown in FIGS. 2A and 2B), a beam-focusing structure 26 which surrounds the slow-wave structure 24, a signal input port 28 and a signal output port 30 which are coupled to opposite ends of the slow-wave structure 24 and a collector 32. A housing 34 is typically provided to protect the TWT elements.

In operation, a beam of electrons is launched from the electron gun 22 into the slow-wave structure 24 and is guided through that structure by the beam-focusing structure 26. A microwave input signal 36 is inserted at the input port 28 and moves along the slow-wave structure to the signal output port 30. The slow-wave structure 24 causes the phase velocity (i.e., the axial velocity of the signal's phase front) of the microwave signal to approximate the velocity of the electron beam.

As a result, the beam's electrons are velocity-modulated into bunches which overtake and interact with the slower microwave signal. In this process, kinetic energy is transferred from the electrons to the microwave signal; the signal is amplified and is coupled from the signal output port 30 as an amplified signal 38. After their passage through the slow-wave structure 24, the beam's electrons are collected in the collector 32.

The beam-focusing structure 26 is typically configured to develop an axial magnetic field. A first configuration includes a series of annular, coaxially arranged permanent magnets 40 which are separated by pole pieces 41. The magnets 40 are typically arranged so that adjacent magnet faces have the same magnetic polarity. This beam-focusing structure is comparatively light weight and is generally referred to as a periodic permanent magnet (PPM). In TWTs in which output power is more important than size and weight, a second beam-focusing configuration often replaces the PPM with a solenoid 42 (partially shown adjacent the input port 28) which carries a current supplied by a solenoid power supply (not shown).

As shown in FIGS. 2A and 2B, TWT slow-wave structures generally receive an electron beam 52 from the electron gun (22 in FIG. 1) into an axially-repetitive structure. A first exemplary slow-wave structure is the helix 43 shown in FIG. 2A. A second exemplary slow-wave structure is the coupled-cavity circuit 44 shown in FIG. 2B. The coupled-cavity circuit includes annular webs 46 which are axially spaced to form cavities 48. Each of the webs 46 forms a coupling hole 50 which couples a pair of adjacent cavities. The helix 43 is especially suited for broad-band applications while the coupled-cavity circuit is especially suited for high-power applications.

In another conventional TWT configuration, (not shown) an oscillator is formed by replacing the output port 30 with a microwave load. Random, thermally generated noise interacts with the electron beam on the slow-wave structure 24 to generate a microwave signal. Energy is transferred to this signal as it moves along the slow-wave structure. This oscillator signal generally travels in an opposite direction from that of the electron beam (i.e., the TWT functions as a backward-wave oscillator) so that the oscillator signal is coupled from the port 28.

TWTs are capable of amplifying and generating microwave signals over a considerable frequency range (e.g., 1–90 GHz). They can generate high output powers (e.g., >10 megawatts) and achieve large signal gains (e.g., 60 dB) over broad bandwidths (e.g., >10%).

The electron gun 22, the signal input port 28, the signal output port 30 and the collector 32 of FIG. 1 and the helix 43 of FIG. 2A, are again shown in the TWT schematic 20 of FIG. 3 (for clarity of illustration, the slow-wave structure is not shown in the schematic). As described above with reference to FIGS. 1 and 2A, the helix 43 is an exemplary slow-wave structure and the signal input port 28 and signal output port 30 are coupled to opposite ends of this exemplary slow-wave structure, has a cathode 56 and an anode 58 and the collector 32 has a first annular stage 60, a second annular stage 62 and a third stage 64. Because the third stage 64 generally has a cup-like or bucket-like form, it is sometimes referred to as the "bucket" or "bucket stage".

The helix 43 and a body 70 of the TWT are at ground potential. The cathode 56 is biased negatively by a voltage $V_{cath}$ from a cathode power supply 74, as indicated by + and − potential indicators. An anode power supply 76 is referenced to the cathode 56 and applies a positive voltage to the anode 58. This positive voltage establishes an acceleration region 78 between the cathode 56 and the anode 58. Electrons are emitted by the cathode 56 and accelerated across the acceleration region 78 to form the electron beam 52.

The electron beam 52 travels through the helix 43 and exchanges energy with a microwave signal which travels along the helix 43 from an input port 28 to an output port 30. Only a portion of the kinetic energy of the electron beam 52 is lost in this energy exchange. Most of the kinetic energy remains in the electron beam 52 as it enters the collector 32. A significant part of this kinetic energy can be recovered by decelerating the electrons before they are collected at the collector walls.

Because of their negative charge, the electrons of the electron beam 52 form a negative "space charge" which would radially disperse the electron beam 52 in the absence of any external restraint. Accordingly, the beam-focusing structure applies an axially-directed magnetic field which restrains the radial divergence of electrons by causing them to spiral about the beam.

However, the electron beam 52 is no longer under this restraint when it enters the collector 32 and, consequently, it begins to radially disperse. In addition, the interaction between the electron beam 52 and the microwave signal on the slow-wave structure 24 causes the beam's electrons to have a "velocity spread" as they enter the collector 32, i.e., the electrons have a range of velocities and kinetic energies.

Electron deceleration is achieved by application of negative voltages to the collector. The potential of the collector is "depressed" from that of the TWT body 70 (i.e., made negative relative to the body 70). The kinetic energy recovery is further enhanced by using a multistage collector, e.g., the collector 32, in which each successive stage is further depressed from the body potential of $V_B$. For example, if the first collector stage 60 has a potential $V_1$, the second collector stage 62 a potential $V_2$ and the third collector stage 64 a potential of $V_3$, these potentials are typically related by the equation $V_B=0>V_1>V_2>V_3$ as indicated in FIG. 3.

The voltage $V_1$ on the first stage 60 is depressed sufficiently to decelerate the slowest electrons 80 in the electron beam 52 and yet still collect them. If this voltage $V_1$ is depressed too far, the electrons 80 will be repelled from the first stage 60 rather than being collected by it. These repelled electrons may flow to the body 70 and this will reduce the TWT's efficiency. Alternatively, they may reenter the energy exchange area of the helix 43. This undesirable feedback will reduce the TWT's stability.

Similar to the first stage 60, successively depressed voltages are applied to successive collector stages to decelerate (but still collect) successively faster electrons in the electron beam 52, e.g., electrons 82 are collected by collector stage 62 and electrons 84 are collected by collector stage 64.

In operation, the diverging low kinetic energy electrons 80 are repelled by collector stage 62, which causes their divergent path to be modified so that they are collected on the interior face of the less depressed collector stage 60. Higher energy electrons 82 are repelled by collector stage 64, which causes their divergent paths to be modified so that they are collected on the interior face of the less depressed collector stage 62. Finally, the highest energy electrons 84 are decelerated and collected by the collector stage 64. This process of improving TWT efficiency by decelerating and collecting successively faster electrons with successively greater depression on successive collector stages is generally referred to as "velocity sorting".

The efficiency gain realized by velocity sorting of the electron beam 52 can be further understood with reference to current flows through the collector power supply 88 which is coupled as indicated by + and − potential indicators, between the cathode 56 and the collector stages 60, 62 and 64. If the potential of the collector 32 were the same as the collector body 70, the total collector electron current $I_{coll}$ would flow back to the cathode power supply 74 as indicated by the current 90 in FIG. 3, and the input power to the TWT 20 would substantially be the product of the cathode voltage $V_{cath}$ and the collector current $I_{coll}$.

In contrast, the currents of the multistage collector 32 flow through the collector power supply 88. The input power associated with each collector stage is the product of that stage's current and its associated voltage in the collector power supply 88. Because the voltages $V_1$, $V_2$ and $V_3$ of the collector power supply 88 are a fraction (e.g., in the range of 30–70%) of the voltage of the cathode power supply 74, the TWT input power is effectively decreased.

Efficiencies of TWTs with multistage collectors are typically in the range of 25–60%, with higher efficiency generally associated with narrower bandwidth. These efficiencies can be further improved by enhancing the velocity sorting of the collector and considerable efforts have been expended towards this goal in the areas of collector design, simulation and prototype test.

In some collectors, velocity sorting is improved by configuring a collector stage to introduce radial asymmetries of the electric field within that stage. These radial asymmetries can often enhance velocity sorting by selectively moving electrons away from the electron beam's axis.

For example, some of the low kinetic energy electrons 80 in FIG. 3 may travel along the collector axis (generally, the axis 21 of FIG. 1). When these coaxial electrons are repelled by the higher depressed collector stages, they may reverse their path and travel back along the collector axis into the energy exchange area of the helix 43. A radial asymmetry in the electric field will cause these electrons to diverge from the collector axis and increase the probability that they will be collected by the collector stage 60.

Radial field asymmetries (electric or magnetic) are conventionally realized, for example, by beveling the leading edge of the first collector stage's aperture 92 as indicated by the broken line 93 in FIG. 3, or by attaching external magnets to the collector body. Although these structures can improve velocity sorting, the former cannot be easily modified and the latter is expensive, time consuming and adds weight and parts complexity.

Because the efficiency of a collector is a function of many elements, (e.g., diameter, length and shape of each stage, spatial interrelationship of stages, stage materials and interaction variations in the slow-wave structure), even complex computer modeling does not completely predict a design's performance. In addition, 3-dimensional computer models are typically limited to simulation of symmetric designs.

Even well-designed velocity sorting may be degraded by the introduction of unexpected a symmetries, e.g., by manufacturing tolerances. Consequently, extensive and expensive prototype testing and design modification are often required to finalize a collector design and time-consuming test adjustments (e.g., attachment of external magnets) are often required during production because of the lack of any ready means for adjusting a collector's radial electric field distributions.

SUMMARY OF THE INVENTION

The present invention is directed to a multistage TWT collector which enhances TWT efficiency by facilitating the selection of radial electric field distributions within the collector.

This goal is achieved with the recognition that collector stages can be formed of annularly-arranged stage segments and that selected voltages can be applied to these segments to realize selected radial electric field distributions. These radial electric field distributions can be combined with conventionally-generated axial electric field distributions to reduce TWT input power.

Some collector embodiments have at least one collector stage which includes a plurality of annularly-arranged stage segments. Other embodiments have at least two collector stages which each include the same or a different number of annularly-arranged segments. To facilitate fabrication, all collector segments may be circumferentially positioned to lie between a plurality of imaginary planes through the collector axis.

The novel features of the invention are set forth with particularity in the appended claims. The invention will be best understood from the following description when read in conjunction with the accompanying drawings.

DETAILED DESCRIPTION OF THE PREFERRED EMBODIMENTS

Figure 4:
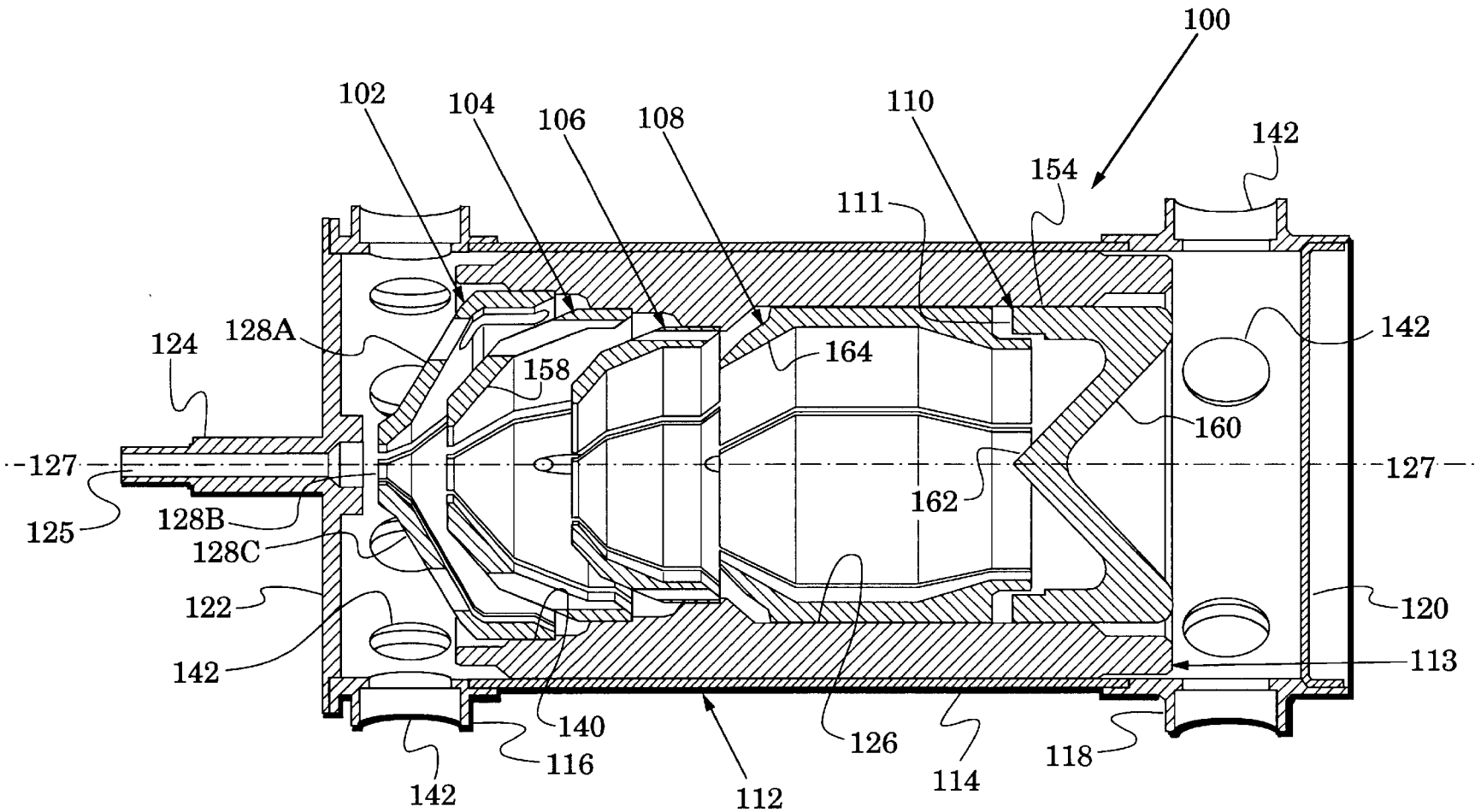
FIG. 4 is a radially-sectioned view of a circumferentially-segmented collector in accordance with the present invention.

FIG. 4 illustrates a circumferentially-segmented collector 100 in accordance with the present invention. The collector 100 includes annular collector stages 102, 104, 106 and 108 and a cup-shaped collector stage 110 which has an annular rim 111 and a perimeter 154. The collector stages 102, 104, 106 and 108 are each formed with annularly-arranged, circumferentially-spaced segments. Selected radial electric field distributions can be realized within each of the collector stages 102, 104, 106 and 108 by applying selected voltages to the segments of these stages (e.g., segments 128A, 128B and 128C). Selected axial electric field distributions can be realized by applying selected voltages to collector stages 102, 104, 106, 108 and 110. These selected radial and axial electric field distributions can be readily combined to enhance the velocity sorting of the collector 100.

In more detail, the collector 100 has an annular collector body 112 and an annular isolator 113 which is positioned within the body 112. The collector body 112 is formed with an annular sleeve 114, a first annular sleeve end 116, a second annular sleeve end 118, a cylindrical cap 120 and an annular disk 122 which extends axially as a tube 124 with an axially-aligned passage 125. The isolator 113 forms a plurality of concentric, annular faces having different radii on its interior surface, e.g., the faces 126 and 140.

The elements of the collector 100 are coaxially assembled about a collector axis 127. The first and second sleeve ends 116 and 118 are connected to opposite ends of the sleeve 114, the cap 120 is connected to the second sleeve end 118 and the disk 122 is connected to the first sleeve end 116, with the tube 124 extending away from the sleeve 114. When installed in a TWT such as the TWT 20 of FIG. 1, the collector body 112 forms part of the TWT's vacuum envelope. Accordingly, the elements of the collector body 112 are preferably formed of a metal, e.g., copper, and permanently joined together, e.g., by brazing.

The isolator 113 is positioned within the collector body 112 and the collector stages 102, 104, 106, 108 and 110 are positioned within respective annular faces, e.g, the face 126, of the isolator 113. The isolator 113 electrically isolates the collector stages and radially conducts heat (generated, for example, by electron's kinetic energy loss) to the collector body 112. The collector stages 102, 104, 106, 108 and 110 are thus positioned in a coaxial relationship with the rim 111 of the collector stage 110 directed towards the the other collector stages.

The collector stages 102, 104, 106, 108 and 110 are preferably formed of a material, e.g., graphite or copper, which has low electrical and thermal resistances. Because the isolator 113 electrically isolates the collector stages from the collector body 112 and conducts heat from the collector stages to the collector body 112, it is preferably formed of a ceramic such as alumina or beryllia. The isolator 113 and the collector stages 102, 104, 106, 108 and 110 can be assembled into the collector body 112 with an interference fit but they are preferably brazed in place (the brazing can be facilitated by first applying a metallic coating to the isolator 113).

Figure 5:
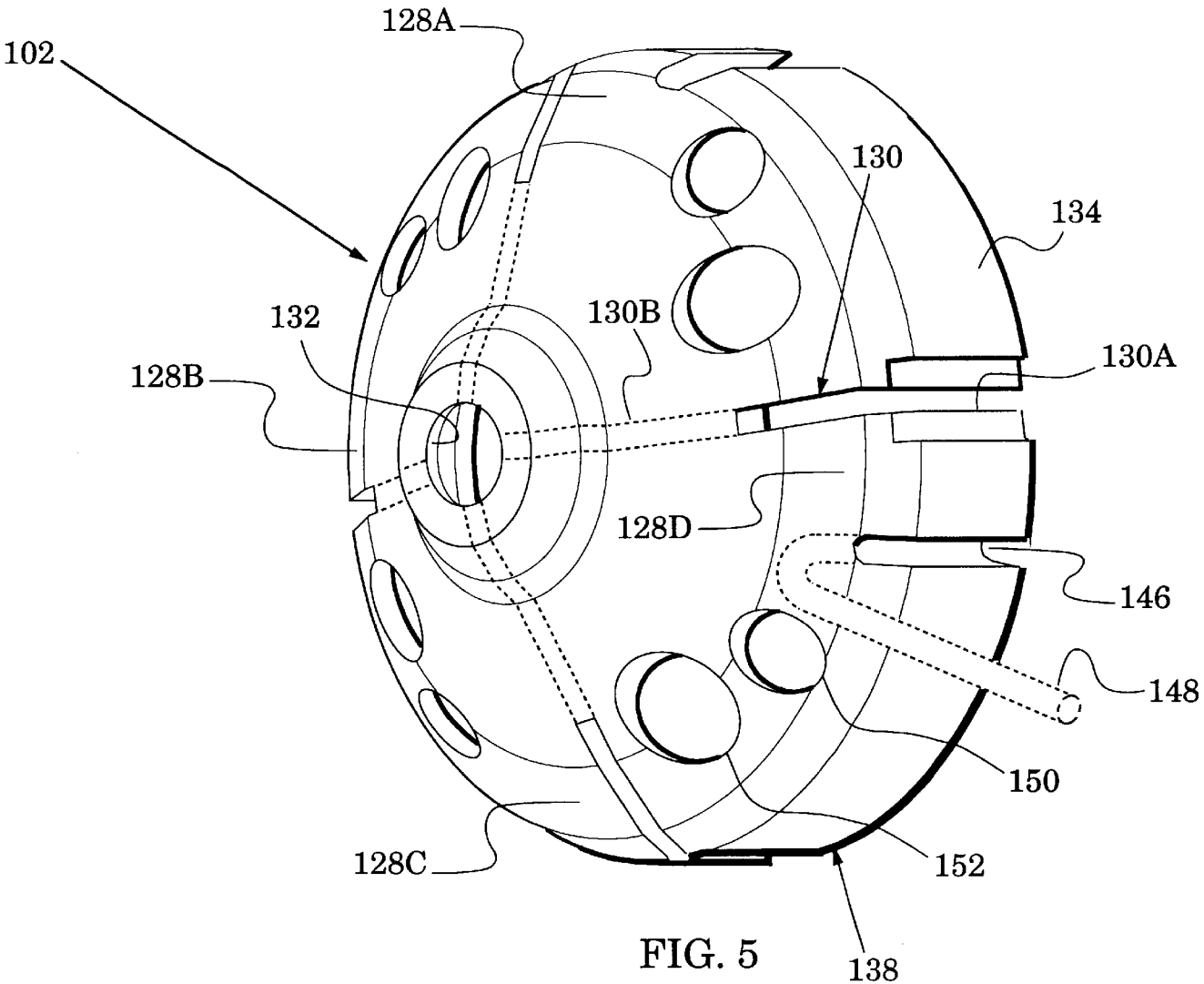
FIG. 5 is a perspective view of a first segmented stage in the collector of FIG. 4.

Each of the annular collector stages 102, 104, 106 and 108 is formed with annularly-arranged, circumferentially-spaced segments. This structure is exemplified by the first collector stage 102 as shown in FIG. 5. The collector stage 102 has segments 128A, 128B, 128C and 128D which are circumferentially spaced by radial spaces 130 and which together form a segmented collector aperture 132 and a segmented collector perimeter 134.

To facilitate its installation into the collector 100, the collector stage 102 may be first formed as an integral collector member 138 which has radially-directed slots 130A that extend inward from the perimeter 134. The slots 130A initiate the radial boundaries of the stage segments but are terminated short of the aperture 132. The collector member 138 is installed in the isolator 113 and its perimeter 134 joined, e.g., by brazing, to its respective annular face 140 of the isolator 113. The slots 130A are then extended, e.g., by sawing, to the aperture 132 as indicated by broken lines 130B. Thus, the extended slots form the spaces 130 of the completed collector stage 102 and separate the collector member 138 into the stage segments 128A, 128C, 128C, and 128D. Essentially, the isolator 112 holds the stage segments in proper alignment as they are separated from the collector member 138.

This installation process can be followed with each of the other annular collector stages 104, 106 and 108. Alternatively, the collector member 138 and similar members for the collector stages 104, 106 and 108 can first be installed into the isolator 113. Then the slot extending operation can be conducted simultaneously on all of the annular collector stages 102, 104, 106 and 108.

Figure 1:
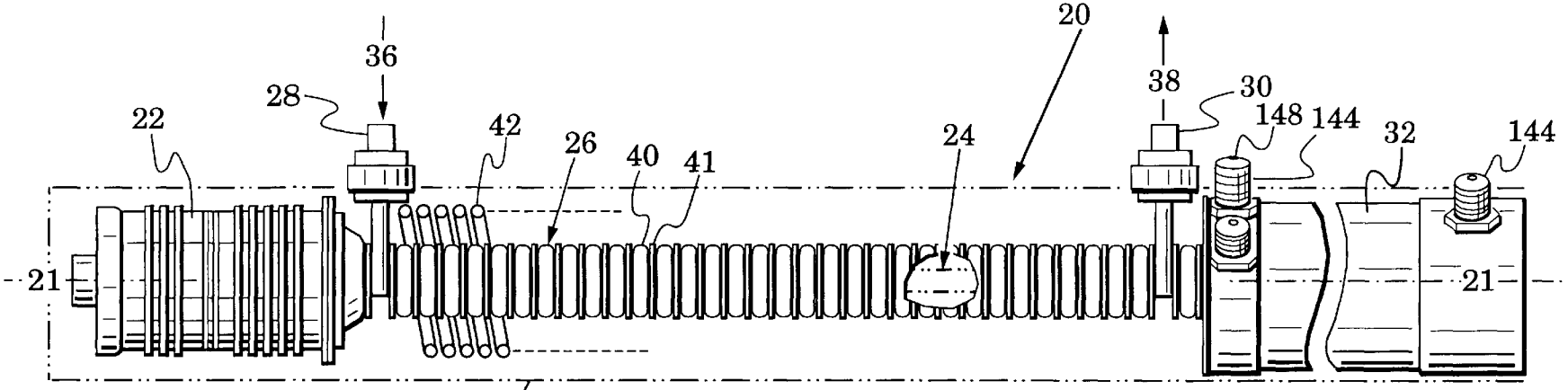
FIG. 1 (PRIOR ART)
FIG. 1 is a partially cutaway side view of a conventional traveling-wave tube (TWT)

As shown in FIG. 4, the first annular sleeve end 116 and the second annular sleeve end 118 each form a plurality of circumferentially-spaced holes 142. Radial feedthroughs, such as the feedthroughs 144 of FIG. 1, are formed from an insulative material, e.g., ceramic, and sealingly installed in each of the holes 142. As shown in FIG. 5, each segment of the annular collector stage 102 has an axially-directed recess 146 formed in its portion of the segmented perimeter 134. After installation of the collector stage 102, each of its segments is electrically accessed with an electrical lead which is brazed to that segment's recess 146. The electrical lead extends axially and then radially through a corresponding one of the feedthroughs.

These electrical leads are exemplified by the electrical lead 148 in FIG. 5, which is shown in broken lines. For clarity of illustration, the lead 148 is referenced in FIG. 1 where its radial end appears within one of the feedthroughs 144. Installation may be facilitated by forming the electrical lead 148 in separate axial and radial portions which are later bonded together.

Similar electrical leads are installed in similar recesses for each segment of the other annular collector stages 104 and 106. In the collector embodiment 100, access for the electrical leads to segments of collector stages 104 and 106 are obtained via respective clearance holes 150 and 152 in each segment of the collector stage 102 as shown in FIG. 5. Because the leads for collector stage 106 must also pass through the collector stage 104, each segment of that collector stage forms a hole which is aligned with one of the holes 152.

Access for the electrical leads to the segments of collector stage 108 can be obtained via clearance holes in the cup-like collector stage 110. Because the perimeters of collector stages 108 and 110 are substantially aligned in the collector embodiment 100 of FIG. 4, the clearances for the electrical leads are preferably obtained by recesses in the perimeter 154 of the collector stage 110.

For clarity of illustration, the electrical leads and feedthroughs are not shown in FIG. 4. Although annularly-arranged collector segments are shown for collector stages 104, 106 and 108, only the exemplary collector segments 128A, 128B and 128C of the first collector stage 102 are referenced.

Although the collector stages 102, 104, 106, 108 and 110 are positioned with different axial positions along the collector axis 127 in FIG. 4, velocity sorting is generally improved by positioning some stages to axially overlap each other. For example, the depressed voltages applied to the segments of the collector stage 106 will cause electrons with a selected range of kinetic energies to diverge radially and be collected on the inner surface 158 of the less depressed segments of collector stage 104. Similarly, velocity sorting is improved by forming the floor 160 of the cup-like collector stage 110 to have an axially-directed cone 162. The cone 162 enhances the radial divergence of electrons with another selected range of kinetic energies. These electrons are then collected on the inner surface 164 of the segments of collector stage 108.

Figure 2B:
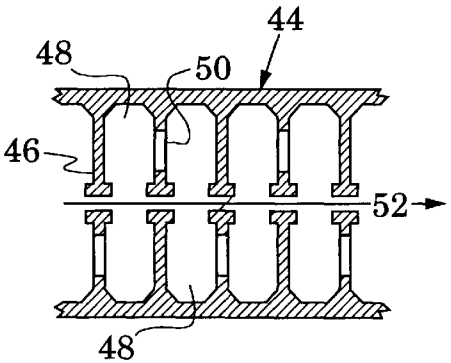
FIG. 2B (PRIOR ART)
FIG. 2B illustrates another conventional slow-wave structure in the form of a coupled-cavity circuit for use in the TWT of FIG. 1.
Figure 2A:
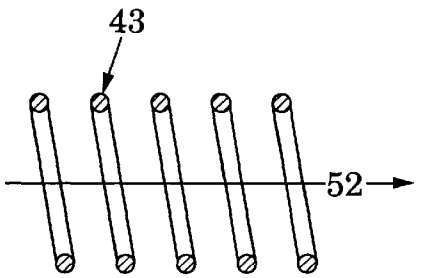
FIG. 2A (PRIOR ART)
FIG. 2A illustrates a conventional slow-wave structure in the form of a helix for use in the TWT of FIG. 1.
Figure 3:
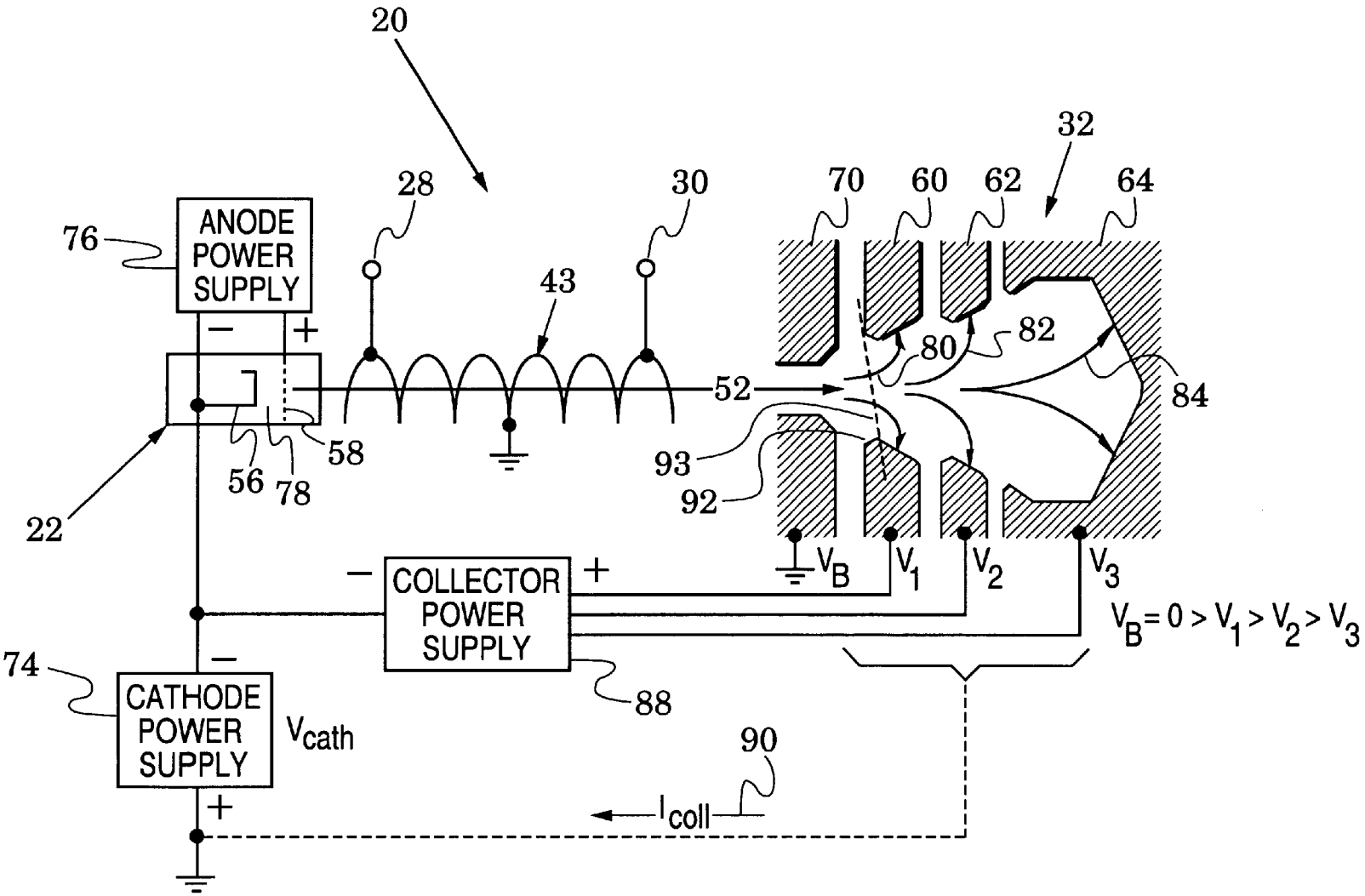
FIG. 3 (PRIOR ART)
FIG. 3 is a schematic of the TWT of FIG. 1 which shows a conventional radially-sectioned, multistage collector.

In an exemplary TWT application, the circumferentially-segmented collector 100 replaces the collector 32 of FIG. 1. Its axis (127 in FIG. 4) is positioned substantially coaxial with the TWT axis (21 in FIG. 1) so that the electron beam (52 in FIGS. 2A, 2B and 3) is received through the passage 125 (see FIG. 4).

In the operation of the collector 100 in this application, selected axial electric field distributions can be realized within the collector 100 by applying selected voltages to the collector stages 102, 104, 106, 108 and 110. In addition, selected radial electric field distributions can be realized by applying selected voltages to the segments of each of the collector stages 102, 104, 106, and 108. By monitoring appropriate signals (e.g., body current through the cathode power supply 74 and collector stage currents through the collector power supply 88 of FIG. 3), these voltages are adjusted to decrease the TWT input power by improved velocity sorting of beam electrons.

Conventional methods of selecting depressed voltages for each collector stage can be initially completed. For example, a voltage is applied to the cup-like collector stage 110 and depressed while observing the body current through the cathode power supply 74, currents from the other collector stages 102, 104, 106 and 108 and the current from the collector stage 110. Increasing this depression increases the amount of kinetic energy which is reclaimed from beam electrons that reach the stage 110.

However, at some level of depression the electrons are repelled from the collector stage 110 and begin to flow back to the TWT body or into the slow-wave structure 24 or to other less-depressed collector stages. This is indicated by an increase in body current through the cathode power supply 74 or an increase of stage currents through the collector power supply 88. The voltage is preferably depressed just enough to cause these currents to begin to rise.

This process is repeated for each of the other collector stages 102, 104, 106 and 108. In general, the common voltage on the segments of each collector stage is depressed to the point at which body current and the current from less-depressed stages begins to rise. At this point in collector alignment, an exemplary set of depressed collector voltages for a 6000 volt cathode would be in the range of 2700–5000 volts.

Subsequently, the voltage can be varied on the collector segments of the invention to achieve greater depression and/or increase the currents from more-depressed stages. For example, the voltages on segments 128A and 128C of collector stage 102 may be depressed respectively more and less than the voltage on segments 128B and 128D. This selection of segment voltages will cause an asymmetric radial electric field distribution which enhances radial divergence of beam electrons.

Thus, electrons which previously were reversing their path along the collector axis (127 in FIG. 4) are urged radially and collected on more-depressed stages. The voltages on segments 128A, 128B, 128C,and 128D can be further altered until the maximum increase in the currents of more-depressed stages is obtained. This process is repeated for the segments of each of the other collector stages.

Although this process has increased the number of voltage potentials required to bias the collector 100, this increase may be offset by simply connecting radially-opposed segments of a collector stage respectively to less-depressed and more-depressed adjacent stages.

In another application of the teachings of the invention, a non-segmented collector design can be built and tested with segmented stages. Thus, the radial currents within the collector can be monitored and this information used to enhance the design.

The teachings of the invention can also be applied during production of TWTs with segmented collectors. During test and alignment, velocity sorting could be improved by simple selection of appropriate collector segment voltages. This means of selecting radial electric field distributions can be considerably less time-consuming than conventional adjustments, e.g., application of external magnets to the collector body.

The teachings of the invention have been illustrated with collector stages which each have four annularly-arranged segments. In addition, the respective segments of all segmented collector stages have been shown to be circumferentially aligned. The segment slots, e.g., the slots 130 of the collector stage 102 in FIG. 5, of all the segmented stages are shown aligned along imaginary axial planes, i.e., imaginary planes through the collector axis 127, so that the collector segments are positioned between a plurality of imaginary axial planes. However, the invention can be applied to various different segmented embodiments. For example, useful embodiments may be realized with any number of segments, with different numbers of segments in different collector stages and with different circumferential positions in different segmented collector stages.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A method of forming a traveling-wave tube collector stage with a plurality of annularly-arranged and circumferentially-spaced stage segments within an annular collector body, comprising the steps of:

initially forming an integral annular collector member that includes a perimeter, an inner aperture and a plurality of radial slots extending inward from said perimeter;

joining said perimeter of said integral annular collector member to said collector body; and extending each of said slots to said inner aperture to separate said integral annular collector member into said plurality of annularly-arranged and circumferentially-spaced stage segments.

2. The method of claim 1, wherein said joining step includes the step of brazing.

3. A multistage collector, comprising:

a collector body;

an annular ceramic isolator positioned within said collector body, said isolator having first and second ends;

a cup-shaped collector stage positioned within said isolator and positioned proximate to said second end of said isolator;

a first annular collector stage positioned within said isolator and positioned proximate to said first end of said isolator; and a second annular collector stage positioned within said isolator and positioned between said first annular collector stage and said cup-shaped collector stage;

wherein said first and second annular collector stages are each provided with at least two annularly-arranged and circumferentially-spaced stage segments;

wherein said collector body provides at least one hole proximate to said first end that provides electrical access to at least one of the stage segments of said first annular collector stage;

wherein at least one of the stage segments of said first annular collector stage provides a respective hole that provides electrical access to at least one of the stage segments of said second annular collector stage;

and wherein said isolator has an interior surface that provides a plurality of concentric, annular faces and wherein each of said first and second annular collector stages and said cup-shaped collector stage is positioned within a respective one of said faces;

and further including at least one electrical lead that passes through said at least one hole in said collector body and through said respective hole in the at least one stage segment of said first annular collector stage and wherein a stage segment of said second annular collector stages provides a recess proximate to said isolator for receipt of said lead.

4. A traveling-wave-tube, comprising:

an electron gun configured to generate an electron beam;

a slow-wave structure positioned so that said electron beam passes through said slow-wave structure;

a beam-focusing structure arranged to axially confine said electron beam within said slow-wave structure; and a multistage collector having;

a collector body;

an annular ceramic isolator positioned within said collector body, said isolator having first and second ends;

a cup-shaped collector stage positioned within said isolator and positioned proximate to said second end of said isolator;

a first annular collector stage positioned within said isolator and positioned proximate to said first end of said isolator; and a second annular collector stage positioned within said isolator and positioned between said first annular collector stage and said cup-shaped collector stage;

wherein said first and second annular collector stages are each provided with at least two annularly-arranged and circumferentially-spaced stage segments;

wherein said collector body provides at least one hole proximate to said first end of said isolator that provides electrical access to at least one of the stage segments of said first annular collector stage;

wherein at least one of the stage segments of said first annular collector stage provides a respective hole that provides electrical access to at least one of the stage segments of said second annular collector stage;

and wherein said isolator has an interior surface that provides a plurality of concentric, annular faces and wherein each of said first and second annular collector stages and said cup-shaped collector stage is positioned within a respective one of said faces;

and further including at least one electrical lead that passes through said at least one hole in said collector body and through said respective hole in the at least one stage segment of said first annular collector stage and wherein a stage segment of said second annular collector stages provides a recess proximate to said isolator for receipt of said lead.

* * * * *